United States Patent [19]

Schmidberger et al.

[11] 4,396,420

[45] Aug. 2, 1983

[54] PROCESS FOR MAKING AG POWDER WITH OXIDES

[75] Inventors: Rainer Schmidberger, Bermatingen; Albert Keil, Pforzheim, both of Fed. Rep. of Germany

[73] Assignees: Dornier System GmbH; Inovan-Stroebe KG, both of Fed. Rep. of Germany

[21] Appl. No.: 348,893

[22] Filed: Feb. 16, 1982

Related U.S. Application Data

[62] Division of Ser. No. 170,064, Jul. 18, 1980, abandoned.

[30] Foreign Application Priority Data

Jul. 21, 1979 [DE] Fed. Rep. of Germany ..... 2929630

[51] Int. Cl.[3] ..... B22F 9/24; B22F 9/26; B22F 9/30

[52] U.S. Cl. ..... 75/0.5 AC; 75/0.5 BC; 75/0.5 C; 75/251

[58] Field of Search ..... 75/0.5 A, 0.5 B, 0.5 C, 75/173 A, 251, 235, 0.5 AC, 0.5 BC; 428/929

[56] References Cited

U.S. PATENT DOCUMENTS

| | | | |
|---|---|---|---|
| Re. 30,052 | 7/1979 | Davies et al. | 75/235 |
| 2,737,445 | 5/1956 | Nossen | 75/0.5 A |
| 2,893,859 | 7/1959 | Triffleman | 75/0.5 AC |
| 3,045,331 | 7/1962 | Ang et al. | 428/929 |
| 3,085,876 | 4/1983 | Alexander et al. | 75/951 |
| 3,317,991 | 5/1967 | Haarbye | 75/0.5 B |
| 3,488,183 | 1/1970 | Schreiner et al. | 75/0.5 B |
| 3,501,287 | 3/1970 | Lever | 75/0.5 A |
| 3,669,634 | 6/1972 | Peters et al. | 428/929 |
| 3,785,810 | 1/1974 | Dürrwächter et al. | 75/173 A |
| 3,877,931 | 4/1975 | Neskora et al. | 75/0.5 A |
| 3,930,849 | 1/1976 | Krock et al. | 75/173 A |
| 4,023,961 | 5/1977 | Douglas et al. | 75/0.5 AC |
| 4,115,325 | 9/1978 | Santala et al. | 75/173 A |
| 4,186,244 | 1/1980 | Deffeyes et al. | 75/251 |

FOREIGN PATENT DOCUMENTS

| | | | |
|---|---|---|---|
| 561828 | 8/1958 | Canada . | |
| 1935329 | 1/1970 | Fed. Rep. of Germany | 75/0.5 C |
| 2423895 | 12/1974 | Fed. Rep. of Germany | 75/0.5 A |
| 36-9163 | 6/1961 | Japan | 75/0.5 B |
| 1066799 | 4/1967 | United Kingdom | 75/0.5 A |

*Primary Examiner*—Michael L. Lewis
*Attorney, Agent, or Firm*—James E. Bryan

[57] ABSTRACT

This invention relates to a silver powder of Ag/CdO composition for use in electrical contacts comprising particles in the size range of about 1 to 10 microns and containing cadmium oxide in the form of a precipitate with a grain size less than about 0.5 micron.

2 Claims, No Drawings

PROCESS FOR MAKING AG POWDER WITH OXIDES

This is a division, of application Ser. No. 170,064, filed July 18, 1980, now abandoned.

The present invention concerns a silver powder in which is dispersed an oxide or metallic phase, and a process for making this powder.

In addition to high electrical conductivity, the properties of materials for electrical contacts should include low susceptibility to welding and high burn resistance in the contacts. Susceptibility to welding and burn resistance of silver contacts can be substantially improved by adding an oxide phase or a metallic phase which is immiscible with silver (for instance Ni).

The proportion of such additives, for instance cadmium oxide, may be up to 15% by weight. Properties such as spark extinction or burn resistance at current shut-off are determined by the kind and amount of the additives and their degree of distribution.

In addition to composite materials composed of two components, composite materials also composed of three or more components are used, for instance silver-metal-metal oxide or silver-metal oxide (1)-metal oxide (2).

Furthermore, the crystal structure will determine the mechanical and electrical properties of an electrical contact. The structurally characteristic parameters in particular are the distribution of the grain size and the porosity. In multi-component materials for contacts, homogeneity and fineness of the foreign phase distribution also are significant. The fineness of the grain and the homogeneity of the foreign phase distribution are determinant for the behavior of the contact.

Ordinarily it is impossible to manufacture the cited composite materials by conventional methods of melting, so that powder-metallurgical or other processes must be employed.

Materials in which the oxide forming metal can be alloyed with silver represent an exception. The alloying takes place while oxygen is excluded, so that a homogeneous distribution of the oxide forming metal is obtained in the silver. The oxide separations then are obtained by the process of internal oxidation. This process is used for instance in silver and cadmium oxide materials.

The powder-metallurgical preparation of heterogeneous sytems is implemented in conventional manner by thoroughly mixing the individual powders and thereupon pressing and sintering them.

The preparation of the individual metal powders is obtained for instance by grinding them in the solid state or by atomizing melts. Furthermore, chemical and electrolytic procedures are known to prepare single-component metal powders.

For instance, the thermal dissociation of silver carbonate results in fine-grain silver powder, or the dissociation of nickel carbonyl at high temperature results in the known nickel carbonyl powder.

Wet-chemical methods such as precipitation from aqueous solutions are used with respect to noble metals such as silver or gold.

A further method is the reduction of metal compounds, which is also used in the extraction of metals from natural ores.

Metal powders can be prepared electrolytically by suitably selecting the bath composition, the bath temperature, the current density, and the concentration of the electrolyte. Silver powders of high purity can be made in this way.

Spraying metal melts or homogeneous alloy melts is also known in the manufacture of metal powders.

However, all of the above cited methods are unsuited to directly preparing metal powders with oxide or metallic foreign phases. Some success was experienced by precipitating two components together from an aqueous phase. Thus, for instance, silver and nickel can be precipitated together from a nitrate solution as carbonates. However, to prepare from them the heterogeneous metal alloy, a further thermal process step is required in which the carbonates are thermally decomposed. In addition to this economic drawback there is also a technical one in that the fine-grain metal powders tend to sinter together during the thermal decomposition of the carbonates, i.e., an agglomeration already takes place prior to the actual sintering process.

A process frequently used in the preparation of a silver/cadmium oxide composite material is internal oxidation. The average grain size of the cadmium oxide precipitates is 5 microns, the particle sizes ranging from 1 to 10 microns. This process does not permit obtaining the homogeneous and fine-grain cadmium oxide distribution with particle sizes less than 1 micron which is desirable for good spark extinction. Furthermore, there is a lack of homogeneity in the cadmium oxide particle sizes depending on the distance from the alloy-air phase boundary surface, which is due to the diffusion of cadmium toward the surface.

All powder-metallurgical processes based on single-component metals, or oxides, result in substantially coarser precipitations of the second phase. This is due to the fact that either the raw material particle sizes of the individual powders are excessive, or that the agglomeration of similar particles cannot be prevented during the grinding and mixing process.

It is the object of the present invention to provide a silver powder suitable for the manufacture of electrical contacts of low welding susceptibility, good spark extinction and good burn-off behavior, and furthermore a process for preparing this powder.

This problem is solved by the invention by a silver powder composed of particles from to 10 microns in size and containing cadmium oxide as a precipitate with a grain size less than 0.5 micron, a common solution of silver and cadmium salts, for instance in the ratio of 9 to 1, being atomized in a hot reactor for the purpose of preparing this powder and being thermally decomposed at temperatures below the melting points of the individual components. Depending upon the composition of the material and the desired end product, the thermal decomposition takes place either in an oxidizing atmosphere (air) or in a reducing atmosphere (hydrogen, former gas, stream-hydrogen mixtures).

In the process of the invention, the individual components of the composite material are very effectively homogenized in the liquid phase. When the common solution is sprayed into the hot reactor, the solvent evaporates suddenly, leaving the solid components behind in which the homogeneity of the liquid-phase element distribution is practically retained. The further reaction of these solid particles with the ambient gas in the hot reactor takes place depending upon the composition of the gas and the material either by the dissociation of the metallic compound to the metal and the gaseous decomposition products of the metallic compound, or by absorbing oxygen into the corresponding metal oxide, or, in the case of a reducing atmosphere, by reducing the metallic compounds to metals. As following the evaporation of the solvent no fusible phases will occur in the individual particles, the agglomeration of individual components in the composite material takes place only by means of relatively slow diffusion processes. The brief dwell time of the particles in the hot reaction zone (several seconds) does not permit the grain to grow beyond the range of 1 micron.

When compared with the competing precipitation processes, the method of the invention offers the advantage that following the powder preparation proper, no further process steps are required. Furthermore, the selection of the compound powders that can be prepared is not restricted by requiring a common precipitant for the components in that compound. Therefore, the process of the invention is also quite suitable for preparing composite materials containing more than two components.

Furthermore, the process of the invention does not require that the precipitants be washed out after the powders are made.

The invention will be further illustrated by reference to the following specific examples:

EXAMPLE 1

A solution of 611.52 g of silver nitrate ($AgNO_3$) and 103.67 g of cadmium nitrate ($Cd(NO_3)_2 \times 4H_2O$) in 4 l of water is sprayed by means of pneumatic double material nozzles into a tubular reactor 0.3 m in diameter and 1.5 m long, the reactor wall temperature being 950° C. Compressed air is used as the atomizing gas. At rates of 10 l/h of solution and 10 $m^3$ per hour of air, 1 kg of silver powder is prepared per hour. The size of the silver/cadmium oxide powder particles so prepared is between about 1 and 5 microns. Following sintering of the powder, the size of the cadmium oxide precipitates in the finished molded article is 0.2 to 0.5 micron.

EXAMPLE 2

A mixture of 97 g of silver and 12 g of tin in a mixture of nitric acid and acetic acid is diluted with water to a total volume of 3.4 liters. The solution is atomized in the reactor under the same conditions as in Example 1, and the powder particles so obtained are separated in a centrifuge from the hot exhaust gases. The diameter of the silver/tin oxide particles is about 1 to 3 microns, the dimensions of the tin oxide precipitates in the sintered molded article amounting to about 50 nanometers.

It will be obvious to those skilled in the art that many modifications may be made within the scope of the present invention without departing from the spirit thereof, and the invention includes all such modifications.

What we claim is:

1. A process for preparing a silver powder of Ag/MeO composition for use in electrical contacts, comprising particles in the size range of about 1 to 10 microns and containing MeO homogeneously dispersed in the Ag particles, said MeO dispersion having a particle size less than about 0.5 micron with MeO being at least one metal oxide of a metal selected from the group consisting of cadmium, tin, zinc, and indium, which process comprises atomizing an aqueous solution of a silver salt and a metal salt in a reaction zone in an oxidizing atmosphere and at a temperature of about 950° C.

2. A process for preparing a silver powder of Ag/Me composition for use in electrical contacts, comprising particles in the size range of about 1 to 10 microns and containing Me homogeneously dispersed in the Ag particles, said Me dispersion having a particle size less than about 0.5 micron with Me being at least one metal selected from the group consisting of nickel, molybdenum and tungsten, which process comprises atomizing an aqueous solution of a silver salt and a metal salt in a reaction zone in a reducing atmosphere and at a temperature of about 950° C.

* * * * *